United States Patent [19]

Aono et al.

[11] Patent Number: 4,946,741

[45] Date of Patent: Aug. 7, 1990

[54] INK RECORDING SHEET

[75] Inventors: Toshiaki Aono; Takeo Sakai, both of Kanagawa, Japan

[73] Assignee: Fuji Photo Film Co., Ltd., Kanagawa, Japan

[21] Appl. No.: 320,124

[22] Filed: Mar. 7, 1989

[30] Foreign Application Priority Data

Mar. 7, 1988 [JP] Japan ..... 63-52939
Apr. 26, 1988 [JP] Japan ..... 63-103191

[51] Int. Cl.[5] ..... B41M 5/00

[52] U.S. Cl. ..... 428/336; 346/135.1; 428/195; 428/335; 428/341; 428/478.2; 428/500; 428/520; 428/532

[58] Field of Search ..... 346/135.1; 428/195, 428/335, 336, 341, 478.2, 500, 520, 532

[56] References Cited

U.S. PATENT DOCUMENTS 4,865,914 9/1989 Malhotra ..... 428/195
4,877,688 10/1989 Senoo et al. ..... 428/195

*Primary Examiner*—Pamela P. Schwartz
*Attorney, Agent, or Firm*—Sughrue, Mion, Zinn, Macpeak & Seas

[57] ABSTRACT

An ink recording sheet comprising a transparent support having thereon an ink recording layer comprising a mixture of an amino group-deactivated gelatin derivative and a polyalkylene oxide.

18 Claims, No Drawings

INK RECORDING SHEET

FIELD OF THE INVENTION

This invention relates to an ink recording sheet for aqueous ink use and, more particularly, to an ink recording sheet improved in evenness of image density of uniformly drawn portions, absorptivity of ink just after drawing, and curling characteristics, and having high optical density and excellent photo transmissibility. Further, it is concerned with an ink recording sheet suitable for use as an original, e.g., for OHP (overhead projector).

BACKGROUND OF THE INVENTION

Ink jet recording is a preferred recording method for use in terminal printers and the like for its advantages such as being noiseless and suitability for high speed recording; it has come into wide use in recent years. In addition, multicolor recording can be effected with ease by using multiple ink nozzles therein. Therefore, various ink jet recording processes have been examined for multicolor recording application.

In particular, because ink jet printers can draw complex images rapidly and exactly, utilization of ink jet printers as apparatus for forming hard copies of the image information including characters and a wide variety of figures drawn with electronic computers has recently been watched with keen interest. Further, there is an increasing need of recording the image information drawn with an electronic computer on transparent recording sheets by means of an ink jet printer, the thus obtained prints being utilized as originals for OHP or the like.

Also, ink recording sheets are employed for plotters and handwriting using aqueous ink pens instead of an ink jet.

As for the ink for ink recording, aqueous ink containing water as a main component is used to advantage in respect of safety and recording characteristics. In many cases, polyhydric alcohols or the like are added to the aqueous ink for the purposes of preventing a pen or a nozzle from choking and enhancing the jetting characteristics.

In those ink recording methods, ordinary paper and so-called ink recording paper having a porous ink-absorbing layer provided on a support have so far been used as a recording sheet. However, these conventional recording sheets have some problems when used as originals for the above-described OHP. For instance, they are, in general, poor in photo transmissibility, or interior in ink acceptability if they have sufficient transparency. More specifically, in many conventional recording sheets, a method of forming a porous ink-absorbing layer on the surface, and causing the sheet to absorb ink in voids of the porous layer and to fix it firmly therein is employed. Accordingly, even when a transparent support is used, there is the problem that the porosity of the ink-absorbing layer aggravates the photo transmissibility.

On the other hand, when the surface of the ink-absorbing layer is nonporous, there is the different problem that since the recording sheet is inferior in aqueous ink acceptability though it has improved photo transmissibility, the aqueous ink remains on the sheet surface for a long time after image recording, thus prolonging the dry fixation time.

For the purpose of solving the foregoing problems, there have been proposed a number of recording sheets which have on a transparent support, a transparent ink-absorbing layer having a high degree of aqueous ink acceptability. Examples of materials to constitute such an ink-absorbing layer include the combined use of polyvinyl alcohol and a water-soluble high molecular weight compound of a polyacrylic acid type as disclosed in JP-A-60-168651 (the term "JP-A" as used herein refers to a "published unexamined Japanese patent application"), the use of hydroxyethyl cellulose as in JP-A-60-262685, the use of a mixture of carboxymethyl cellulose and polyethylene oxide as in JP-A-61-181679, the use of a mixture of a water-soluble cellulose and polyvinylpyrrolidone as in JP-A-61-193879, and the use of a polyalkylene oxide crosslinked by an isocyanate compound as in JP-A-61-32787.

The recording sheets disclosed in these patents, though they have advantages in that they are excellent in photo transmissibility and high in ink acceptability, have some of the following problems:

(1) The ink absorptivity just after image recording is still insufficient, thereby causing unevenness in image density (particularly in the uniformly drawn portions).

That is, fine droplets of aqueous ink are not absorbed by the ink-absorbing layer at the instant of adhering to the surface of the recording sheet; instead it takes the recording sheet from several seconds to several minutes to absorb the major part of the ink droplets attached. In this period, the fine droplets are united into large droplets, so the portions intended to look uniform (uniformly drawn portion) seem to have an uneven or mottled pattern. To make the matter worse, the unevenness or mottled pattern becomes particularly conspicuous when enlarged on a screen by projection with OHP.

(2) In recording images on sheets, each sheet is conveyed with rollers. Accordingly, when the ink absorptivity just after image recording is insufficient, the sheet and image suffer from roller marks.

(3) Since the aqueous ink shows little diffusibility in the lateral direction of the ink absorbing layer when attached to the image recording sheet, there are vacancies and noncovered area between the ink droplets, thus lowering the apparent optical density.

(4) When put on OHP, the recording sheet curls significantly.

SUMMARY OF THE INVENTION

An object of this invention is to provide an ink recording sheet which is improved in evenness of image density, absorptivity of ink just after image recording, and produces images of high density.

Another object of this invention is to provide an ink recording sheet which is high in transparency, and usable as color transparency which has the characteristics as described in the above object.

Further object of this invention is to provide an ink recording sheet which has an improved curling characteristic.

Other objects and effects of this invention will be apparent from the following description.

The above objects of this invention are attained by an ink recording sheet comprising a transparent support having thereon an ink recording layer comprising a mixture of an amino group-deactivated gelatin derivative and a polyalkylene oxide.

DETAILED DESCRIPTION OF THE INVENTION

As a result of examining various combinations of water-soluble binders to be used as a binder for the ink receiving layer which have high transparency and can solve the problems (1) to (4) described hereinbefore, it has been found that the combined use of a gelatin derivative obtained by acylation, deamination or addition of an isocyanate or isothiocyanate compound (which is hereafter called "an amino group-deactivated gelatin derivative") and a polyalkylene oxide has uniquely favorable effects upon the above-described problems (1) to (4), thus achieving this invention.

Of the "amino group-deactivated gelatin derivatives" to be used in this invention, acylated ones can be prepared by treating gelatins with acylating agents, such as organic acids, acid anhydrides, ketenes, acid chlorides or so on. Details of such preparations are described, e.g., in U.S. Pat. Nos. 2,614,298 and 2,768,079, JP-A-46-5182, and H.S. Olcott & H. Frankel Conrat, *Chemical Revs.*, Vol 41, p. 151 (1947).

Gelatin derivatives to which isocyanate (RNCO) or isothiocyanate (RNCS) (wherein R represents an aliphatic or aromatic group) is added can be prepared using the methods described in S. J. Hopkins & A. Wormall, *Biochem. J.*, Vol. 27, p. 1706 (1933).

Deaminated gelatin derivatives can be prepared by the reaction of gelatin with nitrous acid.

As a starting material for the preparation of the gelatin derivative used in this invention, any of gelatins used in this field of art can be employed.

It is important for the gelatin derivatives used in this invention to contain amino groups deactivated through any of the above-described reactions in respect of forming an ink accepting layer capable of not only solving the foregoing problems (1) to (4) at the same time, but also having high transparency. That is to say, the use of gelatins whose amino groups are not deactivated (including gelatins used as the starting material or other gelatins) gives rise to haze in the coated film and failure to achieve satisfactory transparency.

It is desirable that the amino group-deactivated gelatin derivative used in this invention should contain deactivated amino groups in a proportion of 50 mol% or more, preferably 80 mol% or more, and particularly 90 mol% or more, relative to the total of amino groups in the gelatin as the starting material.

Among "amino group-deactivating" methods usable in this invention, acylation is preferred over others.

Specific examples of "amino group-deactivated gelatin derivatives" to be used in this invention include acetyl gelatins, phthaloyl gelatins, malenoyl gelatins, benzoyl gelatins, succinoyl gelatins and methylurea gelatins.

Specific examples of polyalkylene oxides which can be used in this invention include polyethylene oxide and polypropylene oxide. Of these, polyethylene oxide is preferred.

A preferred molecular weight of a polyalkylene oxide to be used in this invention ranges from $5\times10^4$ to $1\times10^6$, particularly from $1\times10^5$ to $5\times10^5$.

The amino group-deactivated gelatin derivative and polyalkylene oxide to be used in this invention may be mixed in any ratios ranging from 20/80 to 80/20, and preferably from 30/70 to 70/30 by weight.

The coverage of the mixture of the amino groupdeactivated gelatin derivative and the polyalkylene oxide on the sheet is generally from 1 to 20 g/m$^2$ and preferably from 2 to 10 g/m$^2$ by weight.

Hydrophilic binders which optionally can be used in this invention together with the mixture of the amino group-deactivated gelatin derivative and the polyalkylene oxide in the layer containing the mixture, or separately therefrom in another layer not containing the mixture in case of a multilayer structure, include conventionally used gelatins, polyvinyl alcohol, highly water-absorbing polymers (that is, polymers containing $COO^-$ and/or $SO_3^-$ group in a proportion of 10% or more, preferably 30% or more, such as polyacrylates, acrylic acid/vinyl alcohol copolymers, etc.), water-soluble cellulose derivatives (e.g., carboxymethyl cellulose, methyl cellulose, hydroxyethyl cellulose), polyvinyl pyrrolidone, polyvinyl pyridinium halides, and vinyl polymers and derivatives thereof, such as cationic modified polyvinyl alcohols (as disclosed in JP-A-60-145879, JP-A-60-220750, JP-A-61-143177, JP-A-61-235182, JP-A-61-235183, JP-A-61-237681, and JP-A-61-261089).

In addition, acryl group-containing polymers, e.g., polyacrylamide, polydimethylacrylamide, polydimethylaminoacrylate, salts of acrylic acid/ methacrylic acid copolymers, sodium polymethacrylate, etc. (as disclosed in JP-A-60-168651 and JP-A-62-9988); natural polymers and their derivatives, e.g., starch, oxidized starch, carboxyl starch, dialdehyde starch, cationic starch, dextrin, sodium alginate, gum arabic, casein, pullulan, dextran, ethyl cellulose, hydroxypropyl cellulose, etc. (as described in JP-A-59-174382, JP-A-60-262685, JP-A-61-143177, JP-A-61-181679, JP-A-61-193879, and JP-A-61-287782); synthetic polymers, e.g., polyvinyl ethers, maleic acid/alkyl vinyl ether copolymers, maleic acid/N-vinylpyrrole copolymers, polyethyleneimine, etc. (as described in JP-A-61-32787, JP-A-61-237680 and JP-A-61-277483); and water-soluble polymers disclosed in JP-A-56-58869 can optionally be included.

Among the above hydrophilic binders, polyacrylates, acrylic acid/vinyl alcohol copolymers, carboxymethyl cellulose and polyvinyl pyrrolidone are preferably included. Further, acrylic acid/vinyl alcohol copolymers and carboxymethyl cellulose are more preferred.

In the aqueous ink-absorbing layer (i.e., the ink receiving layer), a surfactant can be used. As the surfactant, various kinds of surfactants of anionic, cationic, betaine and nonionic types can be employed. Preferably used surfactants include those containing fluorine. The fluorine-containing surfactants may belong to any of the anionic, cationic, nonionic and betaine types, and may be either of low or high molecular weight.

Suitable examples of fluorine-containing low molecular weight surfactants include those disclosed in U.S. Pat. Nos. 3,775,126, 3,589,906, 3,798,265, 3,779,768 and 4,407,937, West German Pat. No. 1,293,189, British Pat. Nos. 1,259,398, JP-A-48-87826, JP-A-49-10722, JP-A-49-46733, JP-A-50-16525, JP-A-50-113221, JP-A-50-161236, JP-A-50-99525, JP-A-51-7917, JP-A-51-32322, JP-A-51-151125, JP-A-51-151126, JP-A-51-151127, JP-A-51-129229, JP-A-52-127974, JP-A-53-84712, JP-A-53-146622, JP-A-54-14224, JP-A-54-485520 and JP-A-55-7762.

Suitable examples of fluorine-containing high molecular weight surfactants include those described in U.S. Pat. Nos. 4,175,969, 4,087,394, 4,016,125, 3,676,123, 3,679,411 and 4,304,852, JP-A-52-129520, JP-A-54-158222, JP-A-55-57842, JP-A-57-11342, JP-A-57-19735, JP-A-57-179837, *Kagaku Sosetsu No.* 27, *Atarashii Fusso Kagaku* (*Elements of Chemistry No.* 27, *New Fluorine Chemistry*), edited by the Japanese Chemical Society (1980) and *Kinosei Gan-Fusso Kobunshi* (*Fluorine-containing Functional Polymers*), edited by Nikkan Kogyo Shinbun-sha (1982).

Those fluorine-containing surfactants can be produced not only by using the methods described in the above-cited literature, but also more generally by fluorinating hydrocarbyl groups of the corresponding surfactants. For details of the fluorination of hydrocarbyl groups, *Shin Jikken Kagaku Koza* (*New Lectures of Experimental Chemistry*), Vol. 4 (I), pp. 308–331, Maruzen (1977) can be referred to. In addition, the fluorine-containing surfactants disclosed in JP-A-62-135826 can be used.

The aqueous ink accepting layer of this invention may have either a monolayer or a multilayer structure.

Examples of multilayer structures applicable to this invention include those described in JP-A-57-89954, JP-A-60-224578 and JP-A-61-12388. In those multilayer structures, the mixture of the amino group-deactivated gelatin derivative and polyethylene oxide of this invention may be incorporated in all of the constituent layers, or any particular layer thereof.

In the layer containing the mixture of the amino group-deactivated gelatin derivative and the polyalkylene oxide, other hydrophilic binders may be used together with the mixture unless the combined use causes phase separation to generate haze. The proportion of other hydrophilic binders is preferably 30 wt% or less, more preferably 15 wt% or less, based on the entire constituents of that layer. However, the optimum depends on the kind of the hydrophilic binder used.

Hardeners which can be used for the ink recording sheet of this invention include those generally known, such as those of the aldehyde type (e.g., formaldehyde, glyoxal, glutaraldehyde), those of the aziridine type (e.g., those described in PB Report 19,921, U.S. Pat. Nos. 2,950,197, 2,964,404, 2,983,611, 3,271,175, JP-B-46-40898 (the term "JP-B" as used herein refers to an "examined Japanese patent publication"), and JP-A-50-91315), those of the isooxazole type, those of the epoxy type (e.g.,

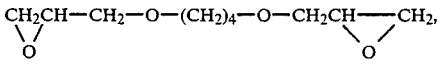

and those disclosed in U.S. Pat. No. 3,047,394, West German Pat. No. 1,035,663, British patent 1,033,518 and JP-B-48-35495), those of the isocyanate type (e.g., an adduct of xylylenediisocyanate and trimethylolpropane, and those disclosed in JP-A-62-209447), those of the vinylsulfone type (e.g., 1,3,5-triacryloyl-hexahydro-s-triazine, bis(vinylsulfonyl)methyl ether, N,N,-ethylene-bis(vinylsulfonylacetamido)ethane, N,N,-trimethylene-bis(vinylsulfonylacetamido), and those described in PB Report 19,920, West German Pat. Nos. 1,100,942, 2,337,412, 2,545,722, 2,635,518, 2,742,308 and 2,749,260, British Pat. No. 1,251,091, Japanese Patent Application Nos. 45-54236 and 48-110996, U.S. Pat. Nos. 3,539,644 and 3,490,911), those of the acryloyl type (e.g., those disclosed in Japanese Patent Application No. 48-27949, and U.S. Pat. No. 3,640,720), those of the carbodiimide type (e.g., those disclosed in U.S. Pat. Nos. 2,938,892, 4,043,318 and 4,061,499, JP-B-46-38715 and Japanese Patent Application No. 49-15095), those of the triazine type (e.g., 2,4-dichloro-6-hydroxy-s-triazine, and those disclosed in West German Pat. Nos. 2,410,973 and 2,553,915, U.S. Pat. Nos. 3,325,287, and JP-A-52-12722), those of the N-methylol type (e.g., dimethylolurea, methyloldimethylhydantoin), dioxane derivatives (e.g., 2,3-dihydroxydioxane), mucohalogenic acids (e.g., mucochloric acid, mucophenoxychloric acid), hardeners of the heavy metal type (e.g., chrome alum), dialdehyde starch, 1-chloro-6-hydroxytriazinylated gelatin, and hardeners of the maleimide, acetylene and methanesulfonate types.

As examples of polymeric hardeners which can be used, mention may be made of the aldehyde group-containing polymers disclosed in U.S. Pat. No. 3,396,029 (e.g., acrolein copolymers), the dichlorotriazinyl group-containing polymers disclosed in U.S. Pat. No. 3,362,827 and *Research Disclosure*, No. 17333 (1978), the epoxy group-containing polymers disclosed in U.S. Pat. No. 3,623,878, the polymers containing active vinyl groups or precursor groups thereof, as disclosed in *Research Disclosure*, No. 16725 (1978), U.S. Pat. No. 4,161,407, JP-A-54-65033 and JP-A-56-142524, and the active ester group-containing polymers disclosed in JP-A-56-66841. The amount of hardener, although not particularly limited as to amount, is preferably added in a proportion of about 0.1 to 30 wt%, particularly 0.5 to 10 wt%, based on the amount of those constituents capable of reacting with the hardener among the hydrophilic colloids used as a binder.

Of the above-cited hardeners, those of the epoxy, isocyanate, aldehyde and heavy metal types are especially preferred.

The aqueous ink receiving layer is provided on at least one side of the transparent support; providing the layer on both sides has an advantage in that judgment as to the recording side of the recording sheet becomes unnecessary.

Transparent supports which can be used in this invention include those conventionally used, e.g., films or plates of polyester resins, diacetate resins, triacetate resins, acryl resins, polycarbonate resins, polyvinyl chloride resins, polyimide resins, cellophane and celluloid, and glass plates.

It is desirable that a transparent support as described above should have a thickness of about 10 to about 200 μm.

Formation of an aqueous ink receiving layer on a transparent support as described above can be effected by coating on the support a composition comprising the aqueous binder (including the amino group-deactivated gelatin derivative, the polyalkylene oxide and other hydrophilic binder), various additives and a coating aid in accordance with any of several known processes, such as a roll coating process, a rod bar coating process, an air knife coating process and a spray coating process, and then by drying the coated composition.

In this invention, the ink receiving layer, a protective layer, an under layer, a backing layer and other layers can be provided by preparing a coating composition; coating the composition by a dipping process, an air knife coating process, a curtain coating process or the like, as well as a hopper coating process described in U.S. Pat. No. 3,681,294; and then drying.

If desirable, two or more layers may be provided simultaneously by the processes described in U.S. Pat. No. 2,761,791 and British Pat. No. 837,095.

The coating composition of the ink receiving layer of this invention can be prepared by the method in which the amino group-deactivated gelatin derivative and the polyalkylene oxide are separately dissolved in water and then two solutions obtained are mixed; or by the method in which two components are dissolved simultaneously in water. If desired, other hydrophilic binders in the form of an aqueous solution or as they are, coating aids (surface active agents), matting agents, color fading preventing agents and the like may be added to the coating composition.

The thickness of the ink receiving layer of this invention is generally from 1 to 50 μm, preferably from 2 to 30 μm, and more preferably from 3 to 15 μm.

For the purpose of increasing adhesion between the transparent support and the aqueous ink receiving layer, the surface of the support can be subjected to an anchor coat treatment or a corona discharge treatment.

The aqueous ink receiving layer of this invention also can contain fillers dispersed therein, e.g., silica, clay, talc, diatomaceous earth, calcium carbonate, calcium sulfate, barium sulfate, aluminum silicate, synthetic zeolite, zinc oxide, lithopone, satin white, etc., to such an extent as not to impair the photo transmissibility of the aqueous ink receiving layer.

In addition, a matting agent can be contained in the surface layer and/or the backing one at a coverage of about 0.005 to 0.1 g/m$^2$ for the purpose of preventing adhesion trouble, such as blocking. Matting agents are well known in the field of photographic arts, and can be defined as inorganic or organic discontinuous solid particles. Specific examples of inorganic matting agents which can be used include oxides (such as silicon dioxide, titanium oxide, magnesium oxide, aluminum oxide, etc.), salts of alkaline earth metals (such as sulfates and carbonates, more specifically barium sulfate, calcium carbonate, magnesium sulfate, calcium carbonate, etc.), silver halide grains incapable of forming images (such as silver chloride and silver bromide, which may contain iodine as halogen component in a slight content), and glass.

In addition to the above-cited materials, those disclosed in West German Pat. No. 2,529,321, British Pat. Nos. 760,775 and 1,260,772, U.S. Pat. Nos. 1,201,905, 2,192,241, 3,953,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504, and so on can be used as the inorganic matting agent.

Examples of an organic matting agent which can be used include starch, cellulose esters (such as cellulose acetate propionate, etc.), cellulose ethers (such as ethyl cellulose, etc.), and synthetic resins. The synthetic resins which can be used as the matting agent are water-insoluble, or slightly water-soluble synthetic polymers, with specific examples including polymers containing as the monomer component(s) an alkyl (meth)acrylate, an alkoxyalkyl (meth)acrylate, a glycidyl (meth)acrylate, a (meth)acrylamide, a vinyl ester (e.g., vinyl acetate), acrylonitrile, an olefin (e.g., ethylene), styrene, and benzoguanamineformaldehyde condensate, individually or in combination of two or more thereof, or in combination with one or more of another monomer such as acrylic acid, hydroxyalkyl (meth)acrylate, sulfoalkyl (meth)acrylate, styrenesulfonic acid or so on.

In addition to the above-cited polymers, epoxy resins, nylons, polycarbonates, phenol resins, polyvinylcarbazoles and polyvinylidene chloride can be used.

Moreover, organic matting agents disclosed in British Pat. No. 1,055,713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924 and 3,767,448, JP-A-49-106821 and JP-A-57-14835 can be used.

Of these organic matting agents, polymethyl methacrylate, benzoguanamine-formaldehyde condensation polymers (or benzoguanamine resins specifically represented by the following formula:

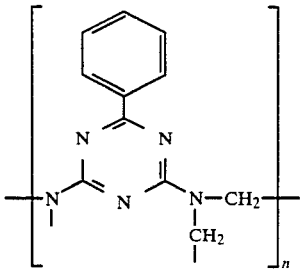

with examples including Epostar (trade name, produced by Nippon Shokubai Kagaku Kogyo Co., Ltd.), polyolefins (e.g., Flobeads LE-1080, CL-2080, and HE-5023, trade names, produced by Seitetsu Kagaku Co., Ltd., Chemipearl V-100, trade name, produced by Mitsui Petrochemical Industries, Ltd.), polystyrene beads (produced by Moritex Co., Ltd.), nylon beads (produced by Moritex Co., Ltd.), AS resin beads (produced by Moritex Co., Ltd.), epoxy resin beads (produced by Moritex Co., Ltd.), and polycarbonate resins (produced by Moritex Co., Ltd.) are preferred over others.

These matting agents may be used in combination of two or more thereof.

Further, a wide variety of known additives including dispersing agents, fluorescent dyes, pH modifiers, defoaming agents, lubricants, discoloration inhibitors, antiseptics and gelatin hardeners can be contained in the aqueous ink absorbing layer.

If desired, a protective layer, an under layer, a backing layer and the like auxiliary layers may be provided.

Since the ink recording sheet of this invention has excellent photo transmissibility and ink drawability, it is not only applicable to OHP, but also can be used for various purposes other than conventional surface image observation, e.g., for the observation of recorder images through projection on a screen or the like with an optical instrument other than OHP, e.g., slide; as a color separation plate for forming the positive plate of color printing; as CMF (color microfilter) to be used for a color display such as a liquid crystal screen or the like; and the like.

Moreover, the ink recording sheet of this invention can be used with recording means other than an ink jet printer, e.g., a plotter equipped with an aqueous ink pen, handwriting, and the like.

This invention will now be illustrated in more detail by reference to the following examples and comparative examples. However, the invention should not be construed as being limited to these examples.

EXAMPLE

On a 100 μm thick polyethylene terephthalate film support was coated the following coating composition using a bar coating process to obtain a recording sheet.

The coating composition was prepared by that: 3.3 cc and 6.6 cc of 5% aqueous solutions of Surfactants (1) and (2), respectively, were added to a mixture of 100 g of a 10% aqueous solution of the phthaloyl gelatin and 200 g of a 5% aqueous solution of the polyethylene oxide (Alkox E-30, a trade name, made by Meisei Chemical Industries, Ltd.), and then 1.3 cc of a 5 wt% aqueous dispersion of Matting Agent (1) and 20.8 cc of a 4% aqueous solution of Hardener (1) were added thereto.

Recording Sheet 100: This Invention

| | |
|---|---|
| Phthaloyl Gelatin (phthaloyl degree: 98%) | 3 g/m$^2$ |
| Polyethylene Oxide (molecular weight: 300,000) | 3 g/m$^2$ |
| Surfactant* (1) | 0.05 g/m$^2$ |
| Surfactant* (2) | 0.1 g/m$^2$ |
| Matting Agent* (1) | 0.02 g/m$^2$ |
| Hardener* (1) | 0.25 g/m$^2$ |

Surfactant*(1)

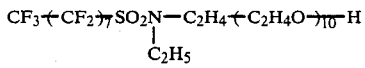

Surfactant* (2)

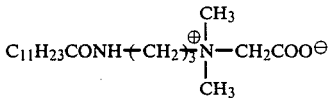

Matting Agent* (1)

Benzoguanamine resin (produced by Nippon Shokubai Kagaku Co., Ltd., average grain size : 10 μm)

Hardener* (1)

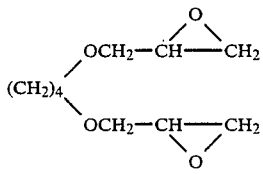

Recording Sheet 101: Comparison

Recording Sheet 101 was prepared in the same manner as Recording Sheet 100, except that alkaliprocessed gelatin was used in place of the phthaloyl gelatin.

Recording Sheet 102: This Invention

Recording Sheet 102 was prepared in the same manner sa Recording Sheet 100, except that polyethylene oxide having a molecular weight of 20,000 was used in place of the polyethylene oxide having a molecular weight of 300,000.

Recording Sheet 103: Comparison

Recording Sheet 103 was prepared in the same manner as Recording Sheet 100, except for changing the coating composition to the following one.

| | |
|---|---|
| Phthaloyl Gelatin (phthaloyl degree: 98%) | 6 g/m$^2$ |

-continued

| | |
|---|---|
| Surfactant* (1) | 0.05 g/m$^2$ |
| Surfactant* (2) | 0.1 g/m$^2$ |
| Matting Agent* (2) | 0.02 g/m$^2$ |
| Hardener* (1) | 0.25 g/m$^2$ |

Recording Sheet 104: Comparison

| | |
|---|---|
| Polyethylene Oxide (molecular weight: 300,000) | 6 g/m$^2$ |
| Surfactant* (1) | 0.05 g/m$^2$ |
| Surfactant* (2) | 0.1 g/m$^2$ |
| Matting Agent* (2) | 0.02 g/m$^2$ |
| Hardener* (1) | 0.25 g/m$^2$ |

Matting Agent* (2)

Flobeads C-1080, produced by Seitetsu Kagaku Co., Ltd. (matting agent of the polyolefin type, particle size: 7 to 10 μm)

Recording Sheet 105: Comparison

Recording Sheet 105 was prepared in the same manner as Recording Sheet 103, except that alkaliprocessed gelatin was used in place of the phthaloyl gelatin.

Recording Sheet 106: This Invention

| | |
|---|---|
| Second Layer (outermost layer) | |
| Acid-Processed Gelatin | 0.5 g/m$^2$ |
| Carboxymethyl Cellulose | 0.5 g/m$^2$ |
| Surfactant* (1) | 0.05 g/m$^2$ |
| Surfactant* (2) | 0.05 g/m$^2$ |
| Matting Agent* (3) | 0.02 g/m$^2$ |
| First Layer | |
| Phthaloyl Gelatin (phthaloyl degree: 98%) | 2.5 g/m$^2$ |
| Polyethylene Oxide (molecular weight: 300,000) | 2.5 g/m$^2$ |

Matting Agent* (3)

Silica (particle size: 2 to 6 μm)

Recording Sheet 107: This Invention

| | |
|---|---|
| Second Layer (outermost layer) | |
| Phthaloyl Gelatin (phthaloyl degree: 98%) | 1 g/m$^2$ |
| Polyethylene Oxide (molecular weight: 300,000) | 1 g/m$^2$ |
| Surfactant* (1) | 0.1 g/m$^2$ |
| Surfactant* (2) | 0.1 g/m$^2$ |
| Matting Agent* (3) | 0.02 g/m$^2$ |
| First Layer | |
| Acid-Processed Gelatin | 2 g/m$^2$ |
| Sodium Polyacrylate | 2 g/m$^2$ |

Recording Sheet 108: This Invention

| | |
|---|---|
| Second Layer (outermost layer) | |
| Phthaloyl Gelatin (phthaloyl degree: 98%) | 0.5 g/m$^2$ |
| Polyethylene Oxide (molecular weight: 300,000) | 0.5 g/m$^2$ |
| Surfactant* (1) | 0.05 g/m$^2$ |
| Surfactant* (2) | 0.05 g/m$^2$ |
| Matting Agent* (4) | 0.02 g/m$^2$ |

-continued

| | |
|---|---|
| First Layer | |
| Phthaloyl Gelatin (phthaloyl degree: 98%) | 2 g/m$^2$ |
| Polyethylene Oxide (molecular weight: 300,000) | 2 g/m$^2$ |

Matting Agent* (4)

Polyethylene Beads (average particle size: 2 to 10 μm)

Recording Sheet 109: This Invention

| | |
|---|---|
| Second Layer (outermost layer) | |
| Phthaloyl Gelatin (phthaloyl degree: 98%) | 1.5 g/m$^2$ |
| Polyethylene Oxide (molecular weight: 300,000) | 1.5 g/m$^2$ |
| Surfactant* (1) | 0.1 g/m$^2$ |
| Surfactant* (2) | 0.5 g/m$^2$ |
| Matting Agent* (3) | 0.02 g/m$^2$ |
| First Layer | |
| Acid-Processed Gelatin | 1 g/m$^2$ |
| Carboxymethyl Cellulose | 1 g/m$^2$ |
| Sumica Gel L-5H (produced by Sumitomo Chemical Co., Ltd.) | 1 g/m$^2$ |
| Hardener* (1) | 0.25 g/m$^2$ |

Recording Sheets 110 and 111: This Invention

Recording Sheets 110 and 111 were prepared in the same manner as Recording Sheet 100, except that the phthaloyl gelatin was changed to acetyl gelatin (acetylation degree: 90%) and malenoyl gelatin (malenoylation degree: 90%), respectively.

On each of the thus prepared recording sheets, images were recorded with an ink jet printer (IO-725, produced by Sharp Corporation). The resulting sheets were examined for unevenness in uniformly drawn parts. The results obtained are shown in Table 1.

TABLE 1

| Number of Recording Sheet | Unevenness of Image | Roller Marks | Curling (mm) | $D_{max}$ (black) | Haze |
|---|---|---|---|---|---|
| 100 (Invention) | A | A | + 2 | 0.87 | A |
| 101 (Comparison) | A | A | +10 | 0.85 (including haze) | C |
| 102 (Invention) | A–B | B | + 5 | 0.80 | A |
| 103 (Comparison) | C | A | +39 | 0.51 | A |
| 104 (Comparison) | A–B | C | +10 | 0.81 | A |
| 105 (Comparison) | C | A | +48 | 0.48 | A |
| 106 (Invention) | A–B | A | + 8 | 0.83 | A |
| 107 (Invention) | A | A | +12 | 0.80 | A |
| 108 (Invention) | A | A | + 1 | 0.88 | A |
| 109 (Invention) | A | A | + 5 | 0.82 | A |
| 110 (Invention) | A | A | + 3 | 0.87 | A |
| 111 (Invention) | A | A | + 1 | 0.86 | A |

Unevenness of images (in uniformly drawn parts):

A: No unevenness

B: A little unevenness

C: Much unevenness

Roller marks (left on the recording sheet by being carried with carrier rollers just after drawing):

A: No roller mark

B: A few roller marks

C: Many roller marks

Curling:

The extent of curling generated when each recording sheet provided with a coat on one side of the A4-sized support was placed on OHP, and kept there for 30 seconds was expressed in terms of the vertical distance from the upside of OHP (glass face) to the support edge.

Maximum Density (Dmax):

Densities of image parts drawn with cyan, yellow, magenta and black inks, respectively, were measured with red light, blue light, green light and white light, respectively (X-rite 310TR, products of Nippon Heiban Kizai K.K.). Density of every dye image had a similar tendency among all samples. Therefore, Dmax shown in Table 1 is represented by that of the black image part.

Haze:

A: Almost transparent

B: A thin haze

C: A thick haze

As can be clearly seen from the results in Table 1, the ink jet recording sheets prepared in accordance with this invention had high transparency, only slight unevenness in image density, no roller stains (high absorptivity of ink just after drawing), high densities of drawn images, and sharply reduced curl when placed on OHP and projected therewith.

While the invention has been described in detail and with reference to specific embodiments thereof, it will be apparent to one skilled in the art that various changes and modifications can be made therein without departing from the spirit and scope thereof.

What is claimed is:

1. An ink recording sheet comprising a transparent support having thereon an ink recording layer comprising a mixture of an amino group-deactivated gelatin derivative and a polyalkylene oxide.

2. An ink recording sheet as claimed in claim 1, wherein said amino group-deactivated gelatin derivative contains deactivated amino groups in a proportion of 50 mol% or more based on the total amount of amino groups in said gelatin.

3. An ink recording sheet as claimed in claim 2, wherein said amino group-deactivated gelatin derivative contains deactivated amino groups in a proportion of 80 mol% or more based on the total amount of amino groups in said gelatin.

4. An ink recording sheet as claimed in claim 3, wherein said amino group-deactivated gelatin derivative contains deactivated amino groups in a proportion of 90 mol% or more based on the total amount of amino groups in said gelatin.

5. An ink recording sheet as claimed in claim 1, wherein said amino group-deactivated gelatin derivative is selected from the group consisting of acetyl gelatins, phthaloyl gelatins, malenoyl gelatins, benzoyl gelatins, succinoyl gelatins and methylurea gelatins.

6. An ink recording sheet as claimed in claim 1, wherein said polyalkylene oxide is polyethylene oxide.

7. An ink recording sheet as claimed in claim 1, wherein the molecular weight of said polyalkylene oxide is from $5\times10^4$ to $1\times10^6$.

8. An ink recording sheet as claimed in claim 1, wherein the molecular weight of said polyalkylene oxide is from $1\times10^5$ to $5\times10^5$.

9. An ink recording sheet as claimed in claim 1, wherein said amino group-deactivated gelatin derivative and said polyalkylene oxide are present in a ratio of from 20/80 to 80/20 by weight.

10. An ink recording sheet as claimed in claim 9, wherein said amino group-deactivated gelatin derivative and said polyalkylene oxide are present in a ratio of from 30/70 to 70/30 by weight.

11. An ink recording sheet as claimed in claim 1, wherein the amount of said mixture of an amino group-deactivated gelatin derivative and a polyalkylene oxide is from 1 to 20 $g/m^2$.

12. An ink recording sheet as claimed in claim 11, wherein the amount of said mixture of an amino group-deactivated gelatin derivative and a polyalkylene oxide is from 2 to 10 $g/m^2$.

13. An ink recording sheet as claimed in claim 1, wherein said ink receiving layer further comprises a hydrophilic binder in an amount of from 30 wt% or less based on the total amount of said layer.

14. An ink recording sheet as claimed in claim 13, wherein said ink receiving layer further comprises a hydrophilic binder in an amount of from 15 wt% or less based on the total amount of said layer.

15. An ink recording sheet as claimed in claim 13, wherein said hydrophilic binder is selected from the group consisting of acrylic acid/vinyl alcohol copolymers and carboxymethyl cellulose.

16. An ink recording sheet as claimed in claim 1, wherein the thickness of said ink receiving layer is from 1 to 50 μm.

17. An ink recording sheet as claimed in claim 16, wherein the thickness of said ink receiving layer is from 2 to 30 μm.

18. An ink recording sheet as claimed in claim 17, wherein the thickness of said ink receiving layer is from 3 to 15 μm.

* * * * *